US009773608B2

(12) United States Patent
Rätz et al.

(10) Patent No.: US 9,773,608 B2
(45) Date of Patent: Sep. 26, 2017

(54) INSULATION STRUCTURE FOR TRANSFORMER, METHOD FOR INSULATING A TRANSFORMER, AND TRANSFORMER COMPRISING INSULATION STRUCTURE

(71) Applicant: CT-Concept Technologie GmbH, Biel-Bienne (CH)

(72) Inventors: Markus Rätz, Leuzigen (CH); Olivier Garcia, Brügg (CH); Sascha Pawel, Biel (CH); Jan Thalheim, Biel (CH)

(73) Assignee: CT-Concept Technologie GmbH, Biel-Bienne (CH)

( * ) Notice: Subject to any disclaimer, the term of this patent is extended or adjusted under 35 U.S.C. 154(b) by 127 days.

(21) Appl. No.: 14/616,411

(22) Filed: Feb. 6, 2015

(65) Prior Publication Data

US 2015/0228401 A1 Aug. 13, 2015

(30) Foreign Application Priority Data

Feb. 13, 2014 (EP) ..... 14155017

(51) Int. Cl.
*H01F 27/28* (2006.01)
*H01F 27/32* (2006.01)
(Continued)

(52) U.S. Cl.
CPC ..... *H01F 27/324* (2013.01); *H01F 5/02* (2013.01); *H01F 17/062* (2013.01); *H01F 27/02* (2013.01);
(Continued)

(58) Field of Classification Search
CPC ..... H01F 5/00; H01F 27/00–27/30
(Continued)

(56) References Cited

U.S. PATENT DOCUMENTS 3,480,897 A * 11/1969 Helberg ..... H01F 41/005 29/597
4,779,812 A 10/1988 Fisher et al.
8,299,879 B2 * 10/2012 Casper ..... F27D 11/00 29/606

FOREIGN PATENT DOCUMENTS

CN 201918248 U 8/2011
DE 2549379 C2 10/1977
(Continued)

OTHER PUBLICATIONS

EP Patent Application No. 14155017.8—European Search Report, dated Apr. 7, 2015 (8 pages).

*Primary Examiner* — Tuyen Nguyen
(74) *Attorney, Agent, or Firm* — Christensen O'Connor Johnson Kindness PLLC

(57) ABSTRACT

A transformer includes a transformer core, a first wire, which forms a first winding, and a second wire, which forms a second winding. The first and second windings are wound around the transformer core. A preformed insulation structure is arranged between the first and second winding and designed to space apart the second winding from the first winding and the transformer core. The preformed insulation structure further includes a first shell which at least partially encloses the transformer core with the first winding, and a second shell which at least partially encloses the transformer core with the first winding. The first and second shells are identical. One or more holes are defined in the first shell and the second shell. The one or more holes cover more than 10% of a surface of the preformed insulation structure.

30 Claims, 12 Drawing Sheets

(51) Int. Cl.

| | |
|---|---|
| ***H01F 27/02*** | (2006.01) |
| ***H01F 27/34*** | (2006.01) |
| ***H01F 5/02*** | (2006.01) |
| ***H01F 17/06*** | (2006.01) |
| ***H01F 30/16*** | (2006.01) |

(52) U.S. Cl.
CPC ..... *H01F 27/28* (2013.01); *H01F 27/2823* (2013.01); *H01F 27/2895* (2013.01); *H01F 27/346* (2013.01); *H01F 30/16* (2013.01)

(58) Field of Classification Search
USPC ..... 336/65, 83, 192, 196, 198, 200, 232
See application file for complete search history.

(56) References Cited

FOREIGN PATENT DOCUMENTS

| | | | |
|---|---|---|---|
| DE | 3110427 | A1 | 11/1982 |
| JP | H 11-312611 | A | 11/1999 |
| JP | 2007-142341 | A | 6/2007 |
| WO | WO 2011/026706 | A1 | 3/2011 |

* cited by examiner

INSULATION STRUCTURE FOR TRANSFORMER, METHOD FOR INSULATING A TRANSFORMER, AND TRANSFORMER COMPRISING INSULATION STRUCTURE

REFERENCE TO RELATED APPLICATION

This application claims priority to European Patent (EP) Application No. 14155017.8, filed Feb. 13, 2014. EP Application No. 14155017.8 is hereby incorporated by reference.

BACKGROUND INFORMATION

Field of the Disclosure

The present invention relates to a preformed insulation structure for a transformer, a transformer comprising a preformed insulation structure, and a method for producing a transformer utilizing a preformed insulation structure. Such devices are used in isolating transformers, for example, in which high voltages are present between a primary winding and a secondary winding.

Background

Transformers, and in particular isolating transformers, can comprise a transformer core and at least two windings. In some isolating transformers, the windings are wound in a bifilar arrangement. One exemplary bifilar arrangement is shown in FIG. 1. Two windings 102, 103, formed with wires, are wound around a ring-shaped transformer core 101 in a plurality of turns. In one example, both windings 102, 103 may wrap substantially along the entire circumference of the ring-shaped transformer core 101 in order to limit leakage inductances. In this arrangement, the insulation resistance between the first winding 102 and the second winding 103 is substantially determined by the insulation resistances of the wires which form the windings. In order to maintain electrical insulation at high voltages, for example voltages between 1 kV and 25 kV, the thickness of the insulation material of the wires can generally be increased. However, increasing the thickness of the insulation material of the wires may increase the overall volume of the windings 102, 103. To maintain the same turns ratio between windings 102, 103 with wires which have a thicker insulating material, a larger transformer core may be used. As such, the overall size of the transformer may increase.

In other examples, the two windings of a transformer can each be wound along their own respective segment on the circumference of a ring-shaped transformer core (for example along a 120° segment). A distance between the first and second windings can thus be increased. However, as a result of this arrangement of the first and second windings, the leakage inductance of the windings can increase and likewise result in an increased sizing of the transformer core and of the entire transformer, as a portion of the transformer core is not used for winding the windings.

SUMMARY OF THE INVENTION

A first preformed insulation structure is designed to be arranged between a first and a second winding of a transformer when the first and second windings are wound around a transformer core of the transformer, wherein the preformed insulation structure is furthermore designed to space apart the second winding from the first winding and from the transformer core. A second preformed insulation structure is designed to be arranged between a first and a second winding of a transformer and a transformer core of the transformer when the first and second windings are wound around a transformer core of the transformer, wherein the preformed insulation structure is furthermore designed to space apart the first and second windings from the transformer core.

A first transformer comprises a transformer core and a first wire, which forms a first winding, a second wire, which forms a second winding, wherein the first and second windings are wound around the transformer core, wherein the transformer furthermore comprises the first or second preformed insulation structure.

The use of a preformed insulation structure makes it possible to construct a compact transformer which is simple to produce. By virtue of its dimensions, the preformed insulation structure defines a minimum distance between the first and second windings. Thus, the insulation structure also reliably defines a minimum value for the electrical breakdown strength between the first and second windings. In particular, an arrangement of the first and second windings in two different planes can be achieved. This arrangement can ensure a compact construction, wherein at the same time the leakage inductance of the arrangement can be kept low. Since the insulation structure is preformed (that is to say even in a separated state substantially stably assumes the form which it also has in the assembled transformer), the assembly of the transformer can additionally be facilitated. By way of example, the second winding can be wound directly around the preformed insulation structure.

In a second transformer according to the first transformer the second winding is wound around the preformed insulation structure.

In a third transformer according to the first or second transformer the preformed insulation structure remains substantially dimensionally stable when the second wire is wound around it.

In a fourth transformer according to any one of the first to third transformers the preformed insolation structure consists of a single piece.

In a fifth transformer according to the fourth transformer the preformed insulation structure comprises a shell designed to at least partly enclose the transformer core with the first winding.

In a sixth transformer according to any one of the first to third transformers the preformed insolation structure includes multiple parts.

In a seventh transformer according to the sixth transformer the preformed insulation structure comprises a first and a second shell, the first and a second shells being designed to at least partly enclose the transformer core and the first winding or the transformer core.

In an eighth transformer according to the seventh transformer the first and second shells are formed identically.

In a ninth transformer according to any one of the first to tenth transformers the preformed insulation structure is designed to completely enclose the transformer core with the first winding or the transformer core.

In a tenth transformer according to any one of the sixth to ninth transformers the preformed insulation structure comprises three or more parts.

In an eleventh transformer according to any one of the first to tenth transformers the preformed insulation structure has one or more holes.

In a twelfth transformer according to the eleventh transformer the holes are round, oval, triangular, rectangular or multi-sided or have an irregular shape.

In a thirteenth transformer according to the eleventh or twelfth transformer the preformed insulation structure has more than ten holes.

In a fourteenth transformer according to any one of the eleventh to thirteenth transformers the one or more holes cover more than 10% of the surface of the preformed insulation structure.

In a fifteenth transformer according to any one of the eleventh to fourteenth transformers the one or more holes are arranged such that when the transformer core and the first winding are arranged within the preformed insulation structure, the entire space not occupied by the transformer core and the first winding within the preformed insulation structure has a fluid connection to the exterior through the one or more holes.

In a sixteenth transformer according to any of the preceding transformers the transformer further comprises a housing designed to receive the transformer core, the first and second windings and the preformed insulation structure.

In a seventeenth transformer according to the sixteenth transformer the transformer further comprises an insulation substance within the housing, the insulation substance enclosing the transformer core and the first and second windings.

In an eighteenth transformer according to the seventeenth transformer the insulation substance is selected from a potting compound, an oil or a gas.

In a nineteenth transformer according to any one of the sixteenth to eighteenth transformers and one of the twelfth to fifteenth transformers the one or more holes in the preformed insulation structure are arranged such that an interior of the housing can be filled with the insulation substance without the formation of cavities when the transformer core when the first and second windings and the first and second shells are arranged in the housing.

In a twentieth transformer according to any one of the sixteenth to nineteenth transformers the housing has one or a plurality of projections in order to space apart the preformed insulation structure from one or a plurality of outer walls of the housing. In a twenty-first transformer according to any one of the preceding transformers the preformed insulation structure defines a closed area.

In a twenty-second transformer according to the twenty-first transformer one or a plurality of sides of the closed area formed by the preformed insulation structure are open towards the transformer core and the first winding.

In a twenty-third transformer according to the twenty-first or the twenty-second transformer the preformed insulation structure has the form of a toroid.

In a twenty-fourth transformer according to any one of the preceding transformers the preformed insulation structure defines a passage through which the second wire can be wound around the transformer core.

In a twenty-fifth transformer according to any one of the preceding transformers the transformer core has a closed form.

In a twenty-sixth transformer according to any one of the preceding transformers the first and/or the second winding extend(s) along the transformer core over at least 300° deg.

In a twenty-seventh transformer according to the twenty-sixth transformer the transformer core is a toroid.

In a twenty-eight transformer according to the twenty-seventh transformer the transformer core is ring-shaped.

In a twenty-ninth transformer according to any one of the preceding transformers the first and/or the second winding extend(s) along the transformer core over at most 175° deg.

In a thirtieth transformer according to any one of the preceding transformers the transformer further comprises a third wire which forms a third winding, the third winding being wound around the transformer core In a thirty-first transformer according to the thirtieth transformer the preformed insulation structure is arranged between the transformer core and the third winding.

In a thirty-second transformer according to the thirtieth or the thirty-first transformer the transformer further comprises one or more further wires which form one or more further windings, the one or more further windings being wound around the transformer core.

In a thirty-third transformer according to the thirty-second transformer the first winding extends along the transformer core over at least 300° deg and the second and the one or further windings each extend along the transformer core over a different segment of the transformer core and are spaced apart from each other.

In a thirty-fourth transformer according to the thirty-third transformer the transformer further includes a further first winding extending over at least 300° deg around the transformer core and being wound in one plane with the first winding.

In a thirty-fifth transformer according to any one of the preceding transformers the first winding is a primary winding and the second and further windings are secondary windings.

In a thirty-sixth transformer according to any one of the preceding transformers the transformer core defines a first plane in which or parallel to which the magnetic flux of the transformer core runs during operation of the transformer, the preformed insulation structure being arranged between the first and second windings such that the second winding is spaced apart from the first winding and the transformer core in a second direction, which is perpendicular to the first plane.

In a thirty-seventh transformer according to any one of the preceding transformers the preformed insulation structure is produced by an injection-moulding method.

In a thirty-eighth transformer according to any one of the preceding transformers the preformed insulation structure comprises a thermoplastic material.

In a thirty-ninth transformer according to any one of the preceding transformers the preformed insulation structure comprises a material having a dielectric constant ranging from 1 to 10 at 0 to 10 MHz.

In a fortieth transformer according to the thirtieth transformer a second preformed insulation structure is arranged between the second and third windings, the second preformed insulation structure spacing apart the third winding from the second winding and the first winding and the transformer core.

In a forty-first transformer according to any one of the preceding transformers the preformed insulation structure comprises one or a plurality of wire holders in which the first wire, the second wire or both and optionally any further wire can be secured.

In a forty-second transformer according to the eighteenth transformer or the eighteenth transformer and any one of the preceding transformers the preformed insulation structure comprises one or a plurality of positioning structures which fix the position the preformed insulation inside the housing in one or more directions.

In a forty-third transformer according to the forty-second transformer the one or a plurality of positioning structures comprise projections arranged on a surface of the preformed insulation structure.

In a forty-fourth transformer according to the forty-second or forty-third transformer the projections are dimensioned such that a distance between the second winding and one or a plurality of side surfaces of the housing is constant.

In a forty-fifth transformer according to any one of the preceding transformers the preformed insulation structure and the housing consist of the same material.

In a forty-sixth transformer according to the seventh transformer or the seventh transformer and any one of the preceding transformers the transformer core defines a first plane in which or parallel to which the magnetic flux of the transformer core runs during operation of the transformer, a top side and an underside of the transformer core extending parallel to the first plane and the first shell enclosing the top side and the second shell encloses the underside of the transformer core.

In a forty-seventh transformer according to the seventh transformer or the seventh transformer and any one of the preceding transformers the transformer core defines a first plane in which or parallel to which the magnetic flux of the transformer core runs during operation of the transformer, a second plane which separates a first half and a second half of the transformer core being perpendicular to the first plane, and wherein the first shell encloses the first half and the second shell encloses the second half of the transformer core.

In a fiftieth transformer according to any one of the preceding transformers the preformed insulation structure has winding aids for the first wire, the second wire or both.

A third preformed insulation structure includes a first shell, which is designed to partly enclose a transformer core, the first shell comprising a plurality of holes, and a first cut-out and a second shell, which is designed to partly enclose a transformer core, wherein the second shell comprises a plurality of holes and a second cut-out, the first and second shells being designed for enabling a wire to be wound around the transformer core through the first and second cut-outs when the first and second shells enclose the transformer core.

A first method for producing a transformer comprises providing a transformer core, winding a first wire around a transformer core in order to form a first winding, arranging a preformed insulation structure, such that the preformed insulation structure encloses at least part of the first winding and of the transformer core, winding a second wire around the preformed insulation structure in order to form a second winding.

In a second method according to the first method the preformed insulation structure spaces apart the second winding from the first winding and the transformer core.

In a third method according to the first or second methods the method further comprises arranging the transformer core with the first and second windings and the preformed insulation structure in a housing and potting the housing with an insulation substance, wherein the preformed insulation structure comprises one or more holes, such that the insulation substance can fill the housing without forming cavities.

In a fourth method according to the second or third method the potting step is carried out under negative pressure conditions.

In a fifth method according to any one of the second to fourth methods the step of potting the housing comprises a die-casting method.

In a sixth method according to any one of the preceding methods the preformed insulation structure comprises one or a plurality of wire holders, the method further comprising fixing a first part of the second wire in the wire holder before the step of winding the second wire around the preformed insulation structure and fixing a second part of the second wire in the wire holder after the step of winding the second wire around the preformed insulation structure.

In a seventh method according to the sixth method the method further comprises inserting of the transformer core with the first winding in a first shell of the preformed insulation structure, securing one or more parts of a first wire and, after securing one or more parts of a first wire, assembling the first shell and a second shell of the preformed insulation structure.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION

Numerous details are presented in the following description in order to enable a profound understanding of the present invention. It is clear to the person skilled in the art, however, that the specific details are not necessary to implement the present invention. Elsewhere, known devices and methods are not portrayed in detail, in order not to unnecessarily hamper the understanding of the present invention.

In the present description, any reference to "one embodiment", "one configuration", "one example" or "example" means that a specific feature, a structure or property which is described in conjunction with this embodiment is included in at least one embodiment of the present invention. In this regard, the phrases "in one embodiment", "one example" or "in one example" at various points in this description do not necessarily all refer to the same embodiment or the same example. Furthermore, the specific features, structures or properties can be combined in any suitable combinations and/or subcombinations in one or a plurality of embodiments or examples. Special features, structures or properties can be included in an integrated circuit, in an electronic circuit, in a circuit logic or in other suitable components which provide the functionality described. Furthermore, it is pointed out that the drawings serve the purpose of elucidation for the person skilled in the art, and that the drawings are not necessarily depicted in a manner true to scale.

Figure 1:
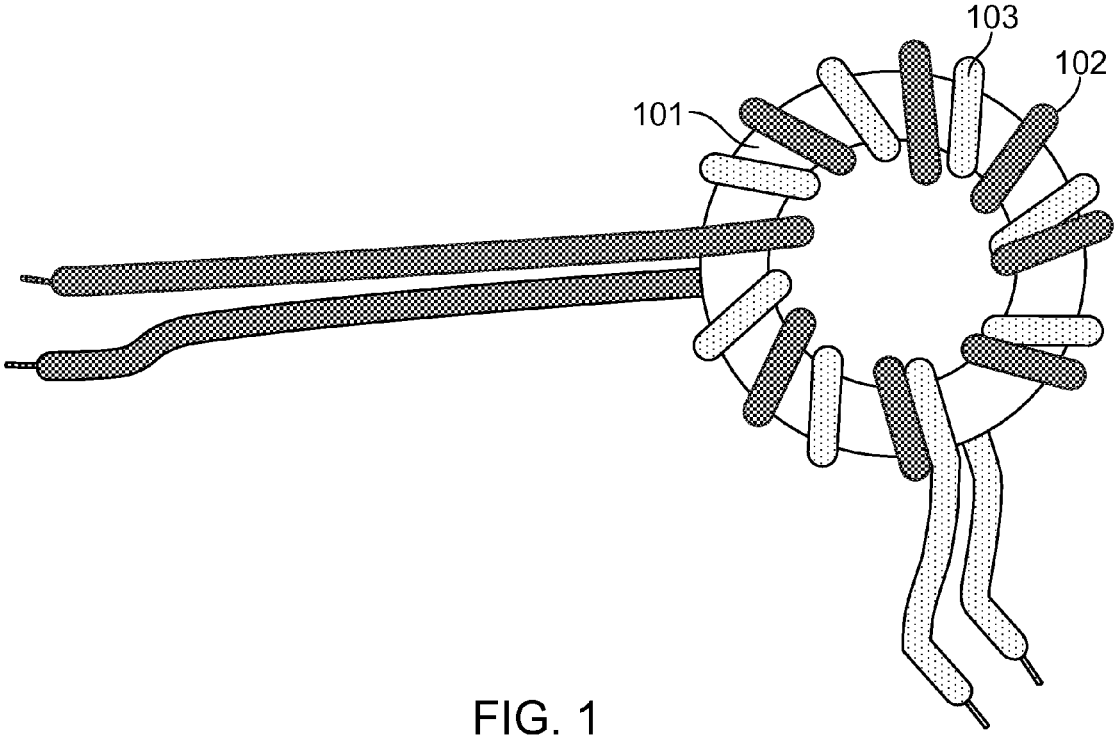
FIG. 1 shows an exemplary arrangement of a transformer core and of first and second windings in accordance with the reference.
Figure 2:
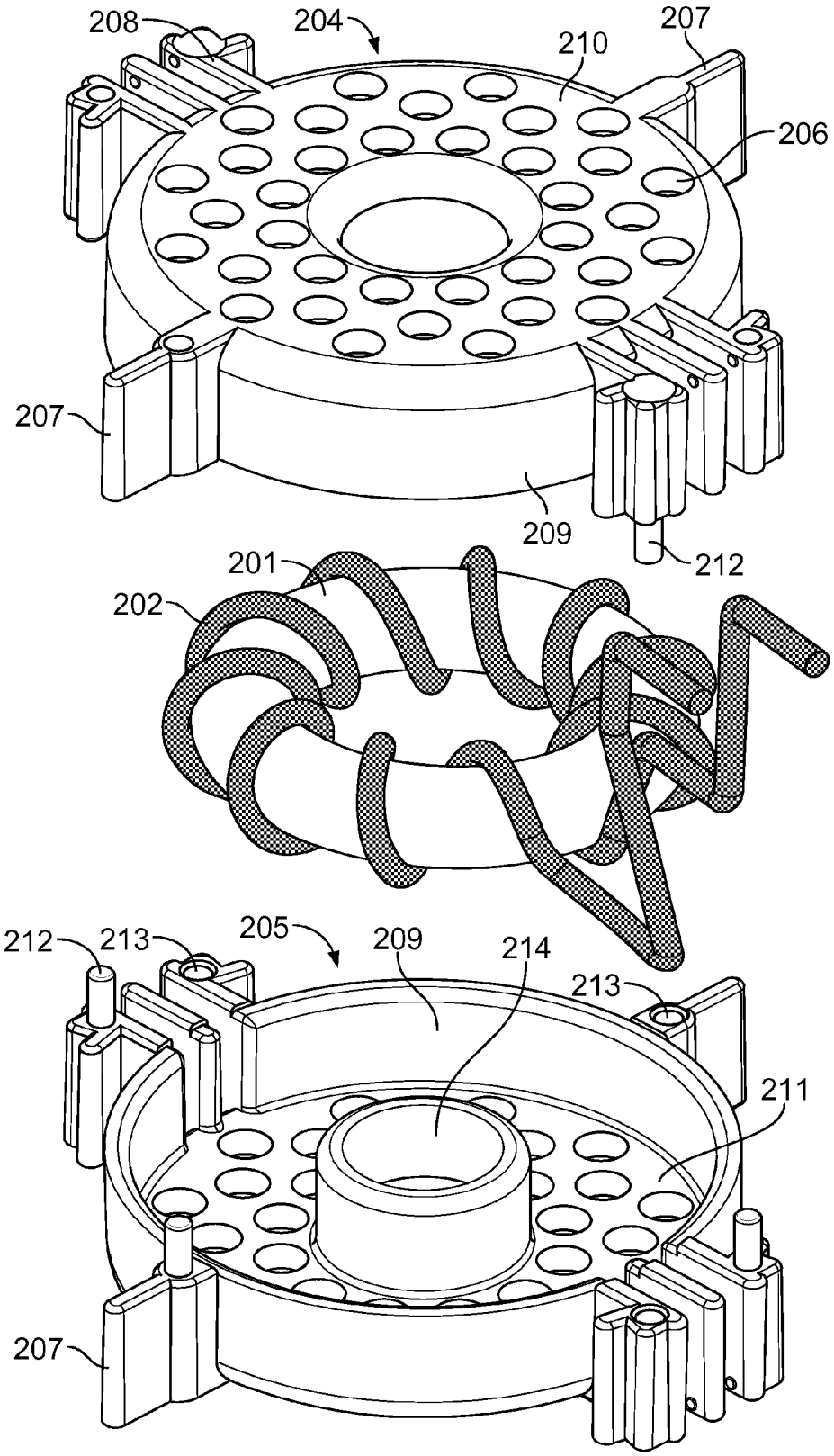
FIG. 2 shows an exploded view of a first exemplary embodiment of a preformed insulation structure and a transformer core with a first winding.
Figure 3:
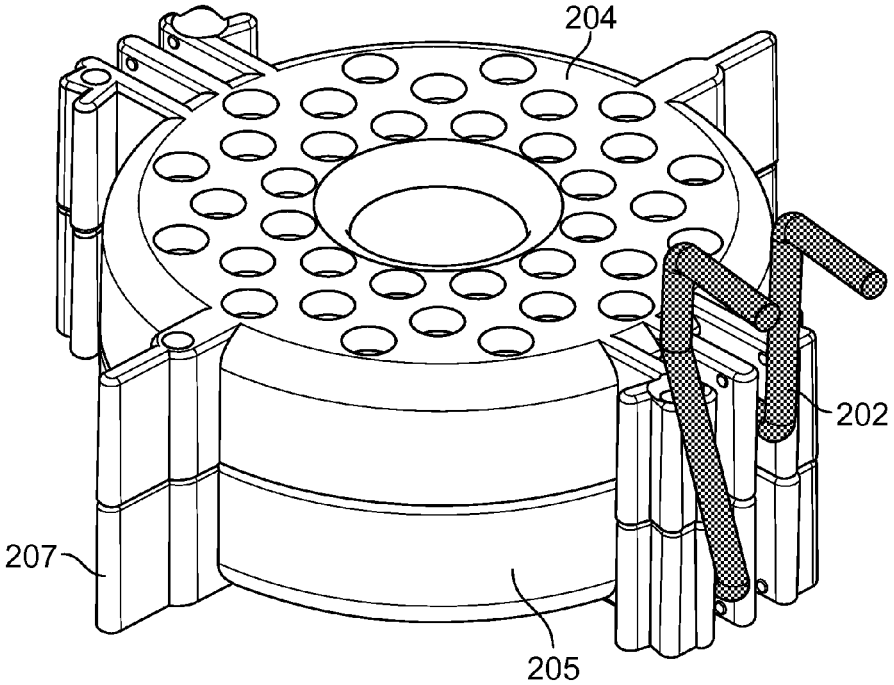
FIG. 3 shows a perspective view of the preformed insulation structure from FIG. 2 enclosing the transformer core and the first winding.
Figure 4:
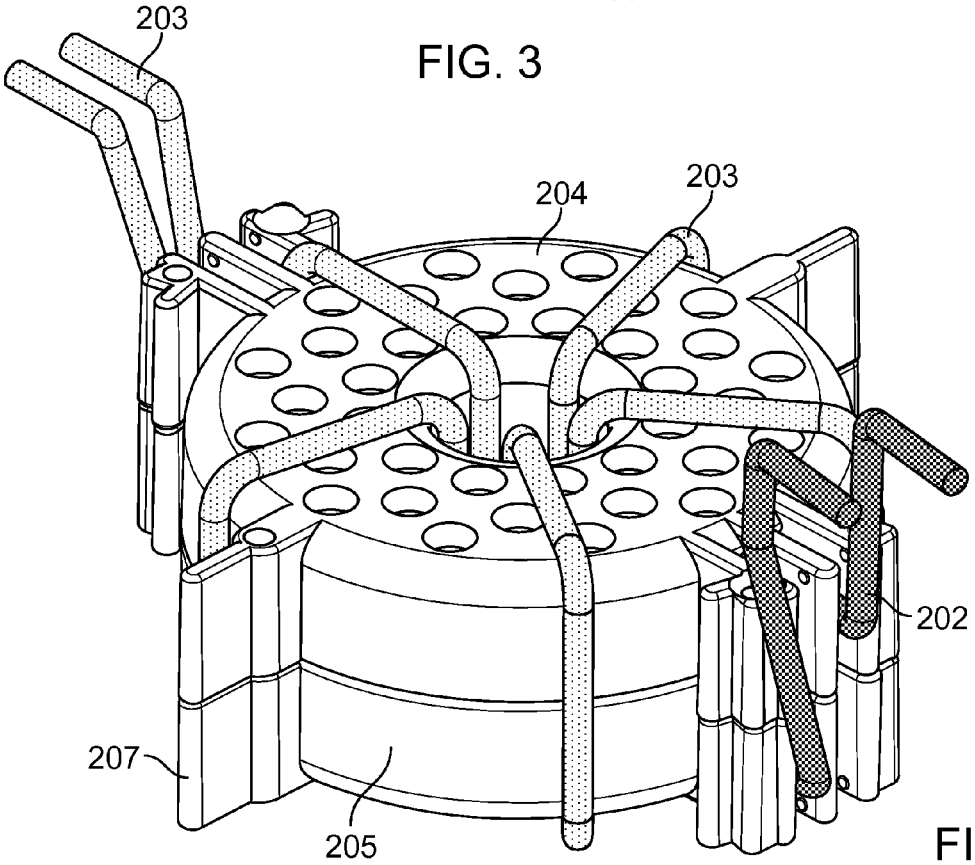
FIG. 4 shows a further perspective view of the preformed insulation structure from FIG. 3, wherein the second winding is wound around the preformed insulation structure.

FIGS. 2, 3 and 4 show different views of a preformed insulation structure designed to space apart a second winding 203 from a first winding 202 and a transformer core 201. The first and second windings 202, 203 may each include a plurality of turns. In other examples, the subsequently described preformed insulation structures may enclose a transformer core 201 and space apart first and second windings 202, 203 from the transformer core 201. The exemplary preformed insulation structure is bipartite and consists of a first shell 204 and a second shell 205. The transformer core 201 extends through the first winding 202, which is formed by a first wire. Or in other words, the first winding 202 is wound around the transformer core 201. This does not mean that the first winding 202 is wound directly around the transformer core 201. This not only holds for the first winding 202 and the transformer core 201, but in general if herein a winding is wound around a certain element. The first and second shells 204, 205 are designed to be able to be assembled in order to enclose the transformer core 201 and parts of the first winding 202 (in other examples the first and second shells 204, 205 are configured to only enclose the transformer core). FIG. 3 shows the first and second shells 204, 205 in an assembled state. In this example, the first and second shells 204, 205 form a cylindrical enclosure for the transformer core 201 and parts of the first winding 202. However, the cylindrical shape of the enclosure formed by the first and second shells 204, 205 is not obligatory. In this regard, the enclosure can also have various other forms (for example, it can have the form of a torus). That applies not only to bipartite insulation structures, but also to unipartite insulation structures or insulation structures having more than two parts.

As can be seen in FIG. 4, the first and second shells 204, 205 are furthermore designed to enable a second wire to be wound around the first and second shells 204, 205. A second winding 203 is thus formed. For this purpose, the first and second shells 204, 205 form an optional inner wall 214 in the example in FIGS. 2 to 4. However, said inner wall 214 can also be omitted. In these examples, the second wire is wound tightly between the top side 210 and the underside 211 of the insulation structure. Further, the second wire 203 is wound between the top side 210 and the underside 211 through the hole created by the inner wall 214.

The first and second shells 204, 205, the first and second windings 202, 203 and the transformer core 201 can form an isolating transformer. As shown in FIG. 4, the shells 204, 205 ensure a predetermined minimum distance between the first winding 202 and the second winding 203. This minimum distance also provides for a minimum breakdown strength of the arrangement (which is additionally determined by the properties of the material from which the first and second shells 204, 205 are produced). Consequently, in some examples, an insulation layer of the wires can be thinner than the insulation layer of the wires which do not utilize the insulation structure of the first and second shells 204, 205. In one example, wires only isolated by an insulation film may also be used. As a consequence thereof, the diameter of the wires can be reduced and the flexibility of the wires can be increased, which can make it easier for the windings to be wound. Moreover, the distance between the first and second windings can be precisely predetermined. Thus, the entire construction can remain compact, since less excess insulation material is introduced. Despite the compact and simple construction of the insulation structure, it is possible, as can be seen in FIGS. 2 to 4, to wind the first and second windings substantially around the entire transformer core. Leakage inductances can be reduced by this measure.

The arrangement shown in FIGS. 2 to 4 has a bipartite insulation structure. However, a bipartite embodiment is not obligatory. In other examples, the preformed insulation structure can be unipartite. In this regard, the preformed insulation structure can be substantially cylindrical and have an opening for inserting the transformer core with the first winding. This opening can be arranged in a sidewall of the cylindrical insulation structure. Alternatively, the unipartite insulation structure can be a single shell. The transformer core with the first winding may be inserted into this single shell, such that an appropriate distance between the first winding and an upper edge of a sidewall of the shell is maintained. The second wining is wound tightly around the shell.

In other examples, the preformed insulation structure can be multipartite. By way of example, each of the shells from FIGS. 2 to 4 can be assembled from two or more parts.

A variety of variants are also appropriate for the configuration of the individual parts of the preformed insulation structure. In the example shown in FIGS. 2 to 4, the first and second shells 204, 205 enclose the transformer core 201 and parts of the first winding 202 completely from all sides. In this case, the preformed insulation structure shown in FIGS. 2 to 4 forms a substantially cylindrical enclosure for the transformer core 201 and parts of the first winding 202. The shells 204, 205 respectively form a circular top side and underside 210, 211 of the cylindrical receptacle and a circumferential lateral wall 209.

In other examples, the first and second shells 204, 205 can form merely a top side and underside 210, 211 of a cylindrical receptacle. The circumferential lateral wall 209 can be (partly or completely) omitted. In such an enclosure, the transformer core would be (partly) visible in a view corresponding to FIGS. 3 and 4. Such an enclosure can nevertheless ensure that a second winding is reliably spaced apart from the first winding and the transformer core. In this regard, a second wire can be wound sufficiently tautly over the top side and underside of the cylindrical receptacle, such that it maintains a predetermined distance from parts of the first winding which surround the transformer core (which themselves can be wound sufficiently tautly around the transformer core), even though the preformed insulation structure does not completely enclose the transformer core.

The arrangement just described is not restricted to cylindrical receptacles. As an alternative to completely omitting the lateral wall 209, it is possible to provide one or more supporting elements in order to improve the dimensional stability of the insulation structure. By way of example, supporting struts can be arranged at the edge of the top side and/or underside 210, 211.

In other examples, the top side and/or the underside 210, 211 of a cylindrical receptacle can be partly or completely omitted. In such a receptacle, the transformer core would likewise be (partly) visible in a view corresponding to FIGS. 3 and 4. Such a receptacle can again ensure that a second winding is reliably spaced apart from the first winding and from the transformer core. In such an insulation structure, the second wire can be wound around the circumferential lateral wall 209, the inner wall 214 and around the top side and underside 210, 211. The arrangement just described is likewise not restricted to cylindrical receptacles.

Although the shells illustrated in FIGS. 2 to 4 form a top side 210 and an underside 211 of a receptacle, the shells are permeated by a plurality of holes 206 (these holes are described in detail further below). Consequently, in the shells illustrated in FIGS. 2 to 4 as well, in the region of the holes 206, the second winding can be tautened over the holes such that a predetermined distance with respect to a first winding 202 possibly wound below the holes 206 is maintained. As an alternative to completely omitting the top side and/or the underside 210, 211, it is possible to provide one or a plurality of supporting elements in order to improve the dimensional stability of the insulation structure. By way of example, supporting spokes can be arranged at the edge of the top side and/or underside 210, 211.

The insulation structure shown in FIGS. 2 to 4 has a plurality of optional plug connections each comprising a pin 212 and a corresponding depression 213 for receiving the pin 212. In this case, a respective pin 212 is arranged on one of the shells 204, 205 and the associated depression 213 is arranged on the respective other shell 204, 205. Instead of the plug connection comprising pins 212 and depressions 213, it is also possible to use any other connecting element which connects the first and second shells 204, 205 to one another. By way of example, it is possible to provide structures which latch into one another, or a hinge that connects the first and second shells in a foldable manner. The arrangement of the connecting elements can be chosen such that the two or more parts of the insulation structure can be connected only in one way or in a plurality of equivalent ways. In the example in FIGS. 2 to 4, the arrangement of two pins/depressions at two opposite points of the shells 204, 205 and only one pin/depression at two further points ensures that the shells 204, 205 can be assembled only in two ways. As a result, it is possible to avoid a situation where the shells (or other multipartite insulation structures) are assembled incorrectly and, under certain circumstances, the second winding has to be removed again in order to rectify the fault.

With reference to FIGS. 2 to 4, on the previous pages an explanation has been given of how a preformed insulation structure can receive a transformer core and can space apart a second winding from a first winding and the transformer core. Further optional features of the shells 204, 205 shown in FIGS. 2 to 4 will be explained below with reference to FIG. 5. However, these features are not restricted to bipartite insulation structures comprising shells. Rather, they can likewise be used in other insulation structures.

Figure 5:
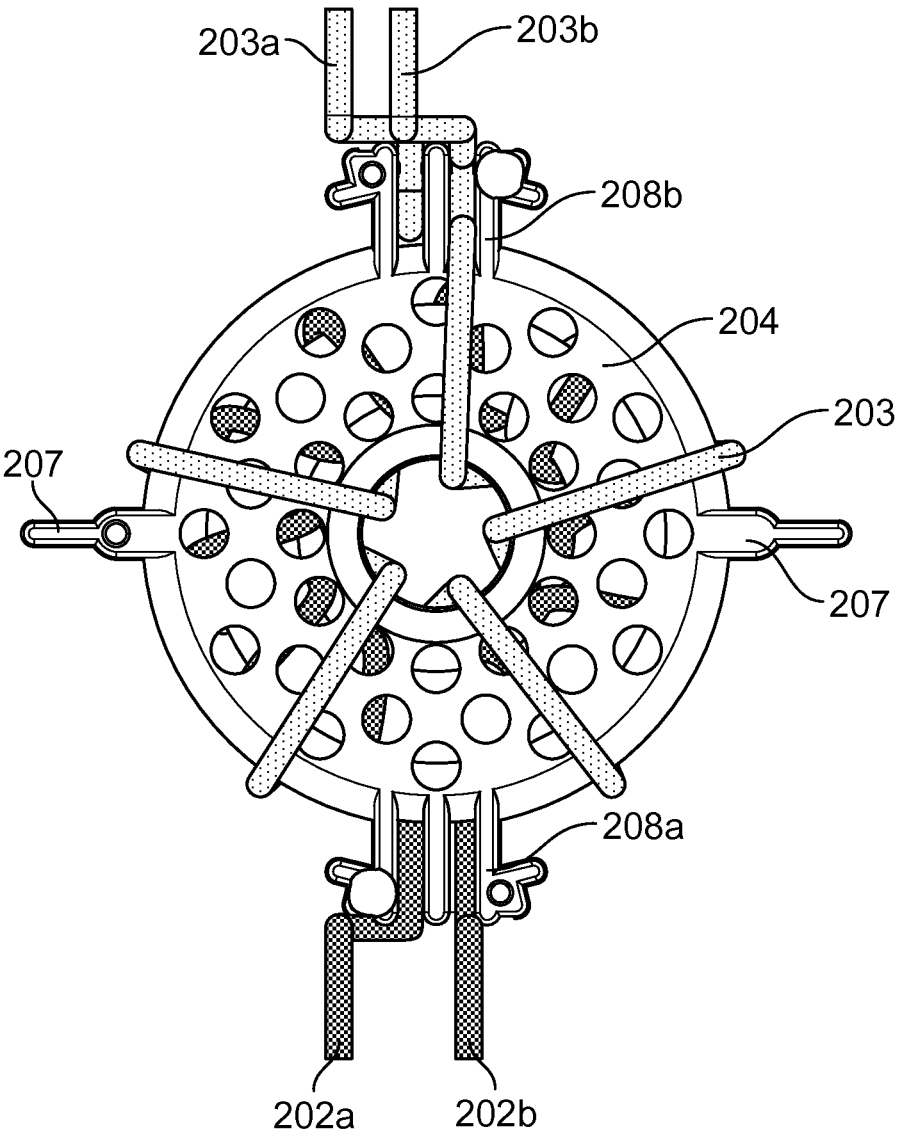
FIG. 5 shows a plan view of an exemplary preformed insulation structure with a second winding wound around the preformed insulation structure.

As can be seen in FIG. 5, the insulation structure can have one or a plurality of wire holders 208*a*, 208*b*. In the example in FIG. 5, two wire holders 208*a*, 208*b* are arranged at opposite sides of the first and second shells 204, 205. A first wire holder 208*a* is designed to fix the first and second ends 202*a*, 202*b* of the first winding 202. In the example in FIG. 5, the first and second ends 202*a*, 202*b* of the first winding 202 can in each case be clamped into a channel of the first wire holder 208*a* and thus fixed. The preformed insulation structure contains bushings (not visible in FIG. 5) in order to lead the first and second ends 202*a*, 202*b* of the first winding 202 from the interior of the preformed insulation structure towards the outside.

In the same way, the first and second ends 203*a*, 203*b* of the second winding 203 can in each case be clamped into a channel of the second wire holder 208*b* and thus fixed. By fixing the ends of the first and second windings 202, 203, it is possible to prevent the latter from changing their position after the first and second windings have been wound. Particularly if the second wire is wound over the assembled first and second shells 204, 205, that can simplify the winding process. In this regard, firstly a first end 203*a* of the second winding 203 can be fixed in the wire holder 208*b*. Afterwards, the remaining wire of the second winding 203 is wound and, finally, a second end 203*b* of the second winding 203 is fixed in the wire holder 208*b*. This makes it possible to prevent the wire from springing back or changing its position during the winding process.

In the devices shown in FIGS. 2 to 5, the wire holders 208 consist of two parts, a respective one of which is fitted to the first and second shell 204, 205, respectively. In other examples, the wire holders can also be unipartite and/or be arranged only on one part of an insulation structure. In addition, the wire holders 208 shown in FIGS. 2 to 5 are in each case designed to fix two ends of the respective wire. In one example, the wire holders 208 maybe designed to fix two ends of multiple wires. In other examples, dedicated wire holders can be provided for each end of the wire. Moreover, each wire can be fixed only at one location or at more than two locations. The locations at which the wire is fixed also need not necessarily be an end of the respective wire. For example, four wire holders arranged uniformly along the circumference of the insulation structure could be provided for the second wire in FIG. 5. Moreover, the wire holders 208 can also have other fixing elements as an alternative to a clamping channel (see FIG. 5). In this regard, the holding device can have an element which is movable between a first state, in which the wire is fixed, and a second state, in which the wire is free.

As just described, the preformed insulation structure can have wire holders for fixing one or a plurality of wires. Furthermore or alternatively, winding aids (for example cutouts or projections) can be introduced into the preformed insulation structure, at or in which winding aids the first and/or second wires can be positioned (not shown in FIG. 5). In one example, the first and second shells 204, 205 have a plurality of lugs on the top side and underside 210, 211, respectively, at which the second wire can be positioned during winding.

Further optional features of the preformed insulation structure and the arrangement of the preformed insulation structure in a housing will now be explained with reference to FIGS. 6 to 8. In order that the illustration is not made unnecessarily complicated, the preformed insulation structure and the first and second windings correspond to the elements shown in FIGS. 2 to 5. However, the optional features described with reference to FIGS. 6 to 8 can also be used with other insulation structures (for example unipartite or multipartite insulation structures).

Figure 6:
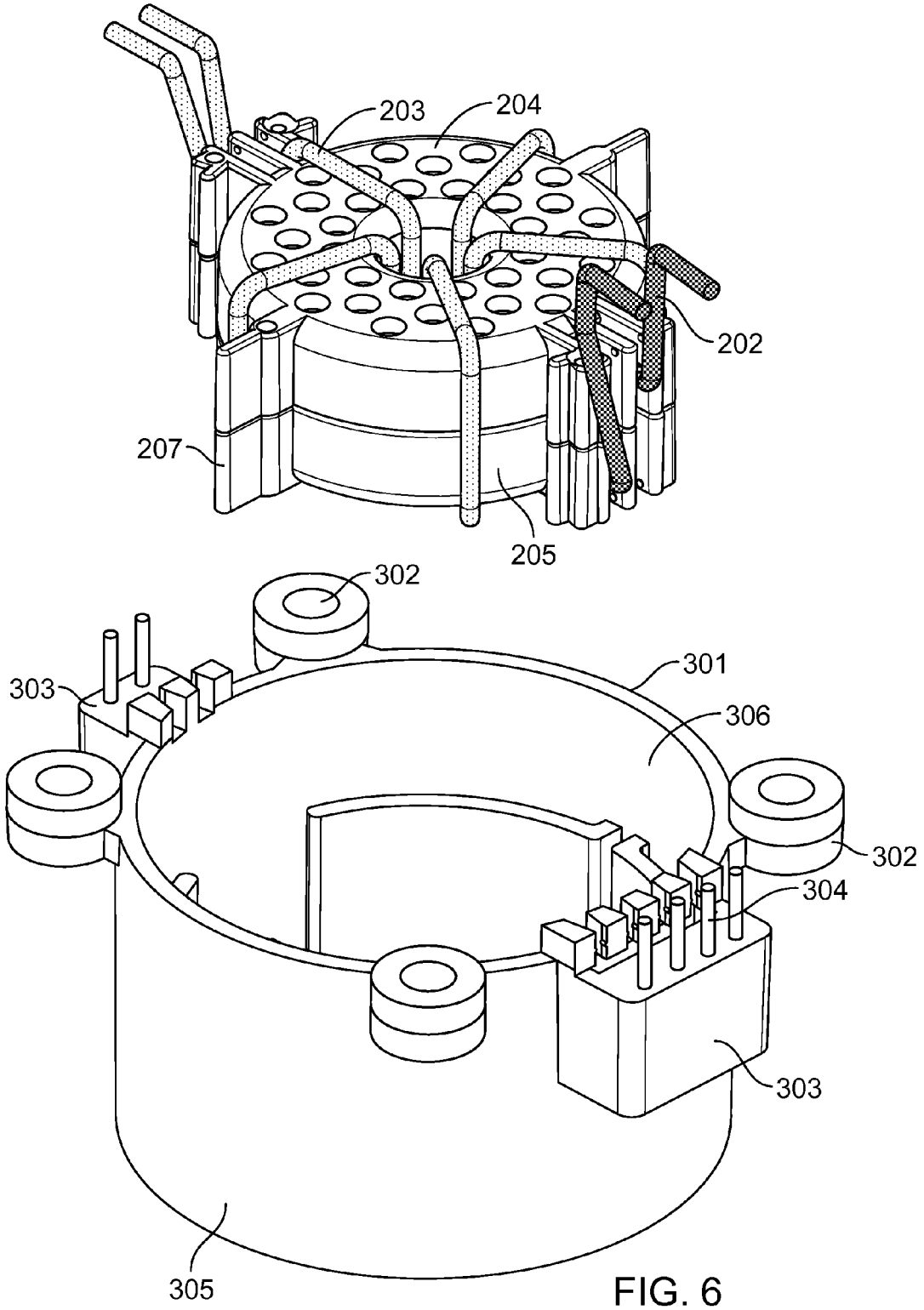
FIG. 6 shows an exploded view of an exemplary embodiment of a preformed insulation structure which encloses a transformer core with a first winding and is wound by a second winding, and an associated housing.

FIG. 6 shows a preformed insulation structure consisting of two shells 204, 205, which corresponds to the preformed insulation structure shown in FIG. 4. The insulation structure is provided with the first and second windings 202, 203. Moreover, FIG. 6 shows a corresponding housing 301, which is designed to receive the preformed insulation structure comprising the first and second shells 204, 205. In the example shown, the preformed insulation structure is wound with the first and second windings 202, 203 and further includes the transformer core 201. For this purpose, the housing 301 forms a sufficiently dimensioned interior. Moreover, the housing 301 has optional mounts 304, to which the ends of the first and second windings 202, 203 are fixed and which constitute an interface for the transformer to the outside world. In the example in FIG. 6, the mounts 304 are arranged on projections 303 fitted to an outer side 305 of the housing 301. Further, the example of FIG. 6 illustrates multiple mounts and projections which are substantially opposite of each other on the housing 301. The ends of the first and second windings can be led through bushings in the housing 301 from the interior of the housing 301 towards the outside and can be fixed there. In FIG. 6, the bare wires (i.e., the insulation material has been removed from the wires) are wound around the mounts 304. However, other forms of mounts 304 are also possible.

The housing can be arranged within a circuit (for example on a printed circuit board). In the example in FIG. 6, the housing has eyes 302 for screws or similar fixing means for this purpose.

Both the preformed insulation structure and the housing 301 can optionally have further features which simplify or enable the positioning and fixing of the preformed insulation structure in the housing 301. These features will now be explained in detail with reference to FIG. 7.

As can already be seen in FIGS. 2 to 6, the preformed insulation structures can have one or a plurality of projections 207 arranged on outer walls of the preformed insulation structure. In the example in FIG. 7, the first and second shells 204, 205 each have two projections 207*a*, 207*b*. The housing 301 has corresponding indentations 307*a*, 307*b*. In the example in FIG. 7, the indentations 307*a*, 307*b* are formed by four free-standing wall elements 309*a*-309*d* extending from the top side of the housing 301 into the interior of the housing 301. The indentations 307*a*, 307*b* and the projections 207*a*, 207*b* are arranged and dimensioned such that the preformed insulation structure with the first and second windings 202, 203 and the transformer core 201 can be inserted into the housing 301 in such a way that the projections 207*a*, 207*b* engage into the indentations 307*a*, 307*b*. As a result, it is possible to define the position of the preformed insulation structure (and thus also that of the first and second windings and of the transformer core) within the housing 301 in the plane of the drawing in FIG. 7. In particular, the distance between the preformed insulation structure and the circumferential lateral wall of the housing 301 and a rotation angle of the preformed insulation structure can be defined. The former can be advantageous because the distance between the preformed insulation structure, and thus also the first and second windings, and the circumferential lateral wall of the housing 301 partially determines the breakdown strength of the transformer with respect to the outside world. With the aid of the projections 207*a*, 207*b* and the indentations 307*a*, 307*b*, it is possible to achieve a substantially equidistant distance between the preformed insulation structure, and thus also the first and second windings, and the circumferential lateral wall of the housing 301. That can prevent the formation of weak points where a dielectric breakdown can occur. As a consequence thereof, the transformer can be designed more compactly, since no or less additional insulation material can be provided for preventing dielectric breakdowns. The setting of the rotation angle of the preformed insulation structure in the housing 301 can facilitate the assembly of the transformer. As shown in FIG. 7, the wire ends of the first and second windings are disposed where they can be led through the wall of the housing 301 to the outside world.

Figure 7:
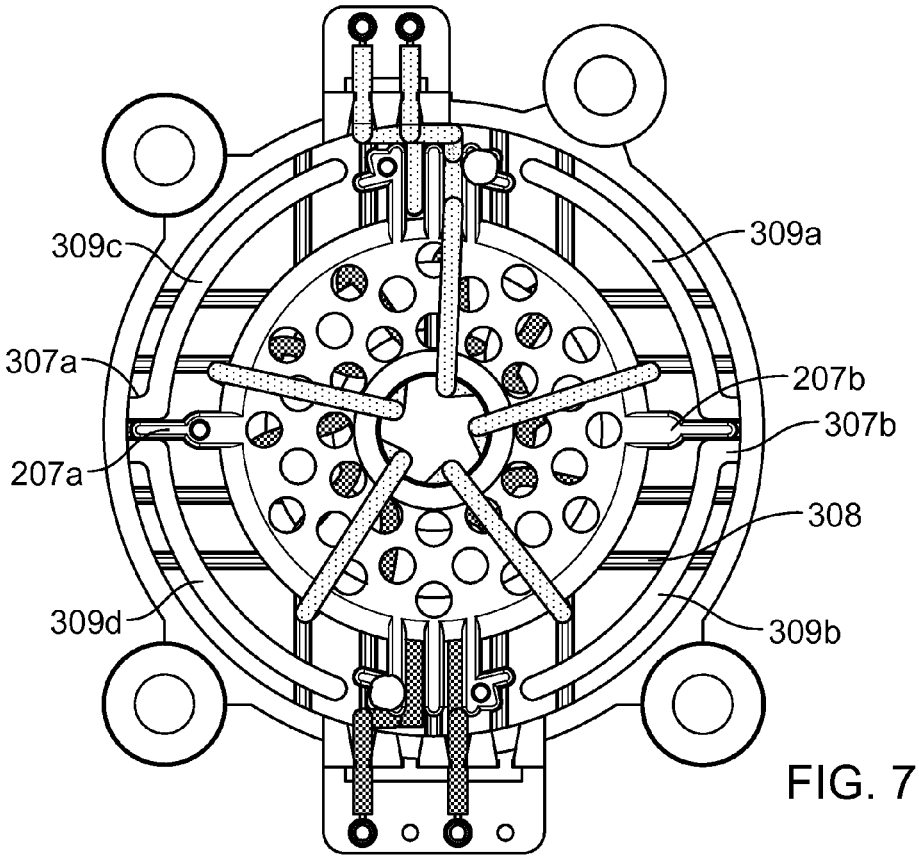
FIG. 7 shows a plan view of the parts of a transformer from FIG. 6.

The positioning of the preformed insulation structure within the housing 301 can also be achieved with positioning structures other than the projections 207*a*, 207*b* and indentations 307*a*, 307*b* shown in FIG. 7. It is thus possible, for example, to omit the inner walls 309*a*-309*d* of the housing. In this example, the distance between the preformed insulation structure and the circumferential lateral wall of the housing 301 can be set just by projections of the preformed insulation structure, these projections can make direct contact with the circumferential lateral wall of the housing 301. Alternatively, indentations can be introduced directly into the circumferential lateral wall of the housing 301, which indentations function in the same way as the indentations 307*a*, 307*b*. In this way, it is also possible to set the rotation angle of the preformed insulation structure in the housing 301. The configuration of the projections is also variable. Two projections 207*a*, 207*b* situated opposite one another are provided in FIG. 7 (and in the previous figures). However, the number and/or position of the projections can also be different. In this regard, three or more projections can be present in other examples. In one example, a projection that can be clamped into a corresponding indentation can be provided for positioning the preformed insulation structure. Alternatively or additionally, other elements of the preformed insulation structure can also serve for positioning within the housing 301. In one example, the wire holders can be configured such that they (at least partly) define a distance between the preformed insulation structure and the circumferential lateral wall of the housing 301.

The projections 207*a*, 207*b* and indentations 307*a*, 307*b* in FIG. 7 can define the position and the rotation angle of the preformed insulation structure in a first plane. Moreover, it can be seen in FIG. 7 that the housing 301 has a multiplicity of projections 308. These projections 308 define the distance between the preformed insulation structure and an underside of the housing 301 (the term "underside" relates to the arrangement shown in FIG. 7 and is relative; normal to the surface of the underside is perpendicular to the first plane just defined). In other examples, the preformed insulation structure (for example the first and/or second shell 204, 205) can have one or a plurality of projections in order to space apart the preformed insulation structure from the underside of the housing.

Figure 8:
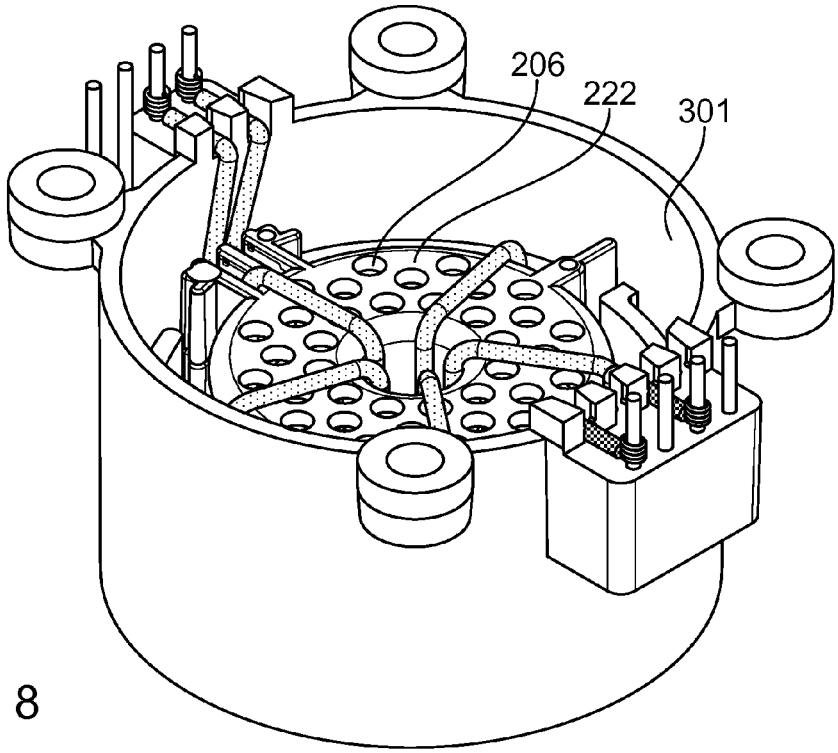
FIG. 8 shows a perspective view of the parts of a transformer from FIG. 6.

A perspective view of the parts of a transformer which are shown in FIGS. 6 and 7 in the assembled state can be seen in FIG. 8. The preformed insulation structure 222 is positioned—optionally with the aid of the positioning aids described in connection with FIG. 7—within the housing 301. A potting compound can then be filled into the housing in order to increase the breakdown strength of the transformer and to encapsulate the windings and the transformer core from the outside world. In order to facilitate the introduction of the potting compound, the preformed insulation structure has a plurality of holes 206. The latter can be arranged such that the interior formed by the preformed insulation structure 222 can be filled without the formation of cavities through the holes 206. The holes 206 can likewise be seen in FIGS. 2 to 7. In this example, the first and second shells 204, 205 each have a multiplicity of holes. Subsequently a potting compound is described as exemplary insulation substance. Other insulation substances can also be used. For example, an insulation fluid (e.g., an insulation oil) or an insulation gas can be employed.

Figure 10:
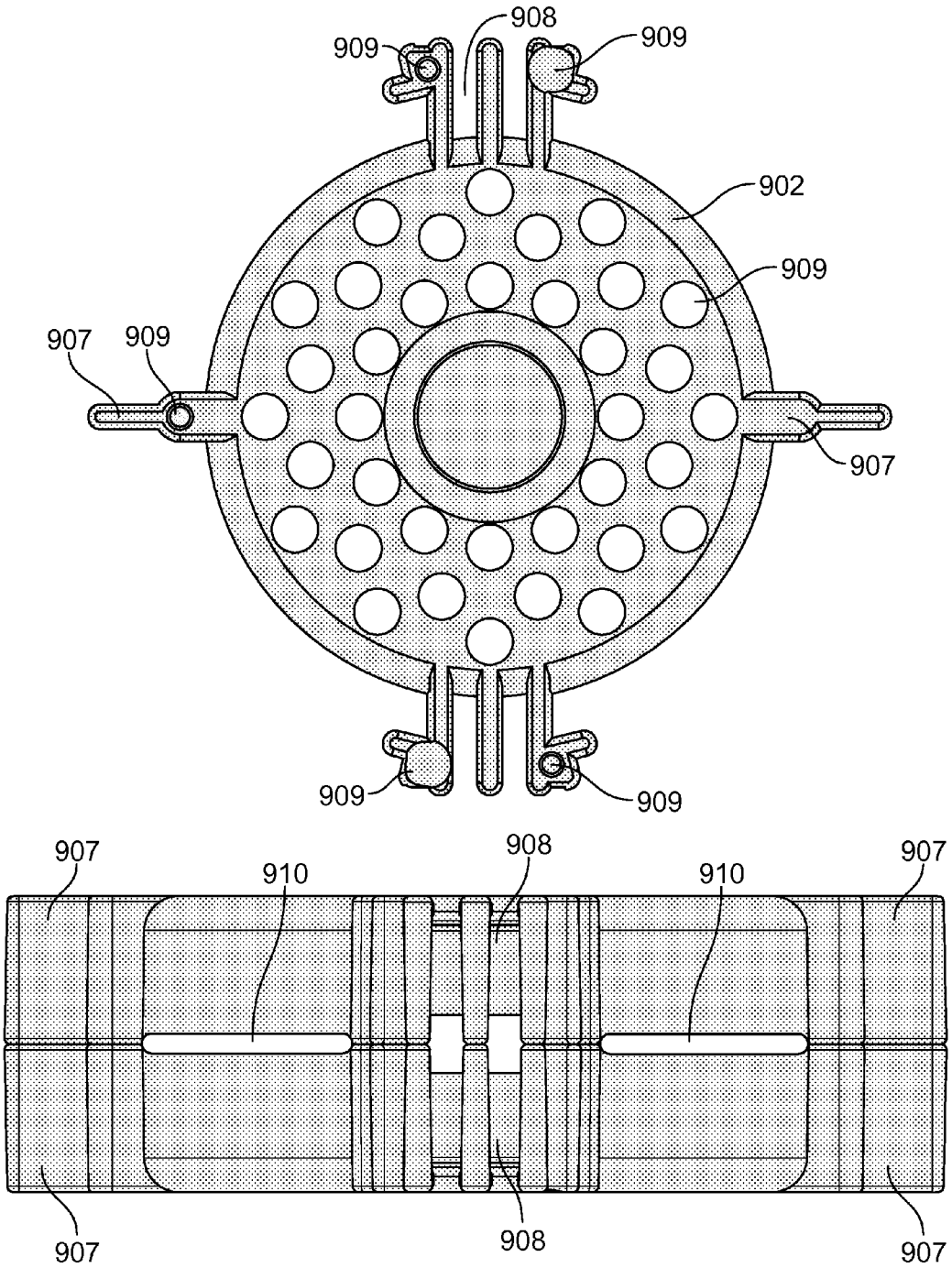
FIG. 10 shows a plan view and a lateral view of the shells from FIG. 9.

The first and second shells 204, 205 can be sized such that additional holes are formed when the first and second shells 204, 205 are assembled. For instance, as can be seen in FIG. 10, elongated slits 910 are formed when the first and second shells 204, 205 are assembled. These slits can improve the flow behaviour of the potting material when filling the first and second shells 204, 205.

The holes 206 arranged on the top side 210 and the underside 211 of the first and second shells 204, 205 shown in FIGS. 2 to 8 are round. However, this geometry is not obligatory. Moreover, the holes need not necessarily be arranged on two opposite sides of the preformed insulation structure (for example on the top side 210 and underside 211). In this regard, the top side and underside of the preformed insulation structure could comprise only webs arranged in a spiked fashion, such that segmented holes are formed. In other examples, the holes can be rectangular, hexagonal or oval. It is merely necessary to ensure that the size, form and position of the holes are chosen such that the potting compound can penetrate through the holes into the interior of the preformed insulation structure. In examples where the top side or underside or the lateral wall of the preformed insulation structure is omitted, the opening thus produced can already suffice for filling the interior of the preformed insulation structure with potting compound. Providing suitable holes makes it possible to ensure that the interior of the preformed insulation structure is reliably filled with potting compound. In particular, it is possible to avoid the formation of bubbles in the interior, which otherwise can generally negatively influence the dielectric breakthrough resistance and in particular the insulation properties of the transformer.

Further details regarding the process for producing the preformed insulation structures and their material properties will now be explained with reference to FIGS. 9 and 10. The preformed insulation structure consisting of two shells, as already shown in FIGS. 2 to 8, is once again illustrated in FIGS. 9 and 10. However, the statements made below are likewise not restricted to this specific embodiment. Rather, all other preformed insulation structures discussed herein can also be produced by the methods presented and with the material properties discussed.

In one example, the preformed insulation structures are produced by means of an injection-moulding method. The preformed insulation structures can thus be produced particularly cost-effectively. As can be seen in FIGS. 9 and 10, the preformed insulation device can consist only of two parts. One or a plurality of positioning structures for positioning the preformed insulation structure within a housing, wire holders and plug connections for connecting different parts of the preformed insulation structure can be produced integrally with the parts for spacing apart the first and second windings. In this regard, the insulation structure in FIGS. 9 and 10 can comprise a first injection-moulded part 901 and a second injection-moulded part 902. Each of the first and second injection-moulded parts 901, 902 in this case has integral positioning structures 907 (also referred to as projections), wire holders 908 and plug connections 909. In this case, not only the specific elements shown in FIG. 9 but also the variants presented with reference to FIGS. 2 to 8 can be produced integrally with the parts for spacing apart the first and second windings. The same applies to preformed insulation structures comprising one or more than two parts. By way of example, the positioning structures 907 for positioning the preformed insulation structure within a housing, the wire holders and the plug connections for connecting different parts of the insulation structure can be produced integrally with only one of a plurality of parts of the preformed insulation structure.

Figure 9:
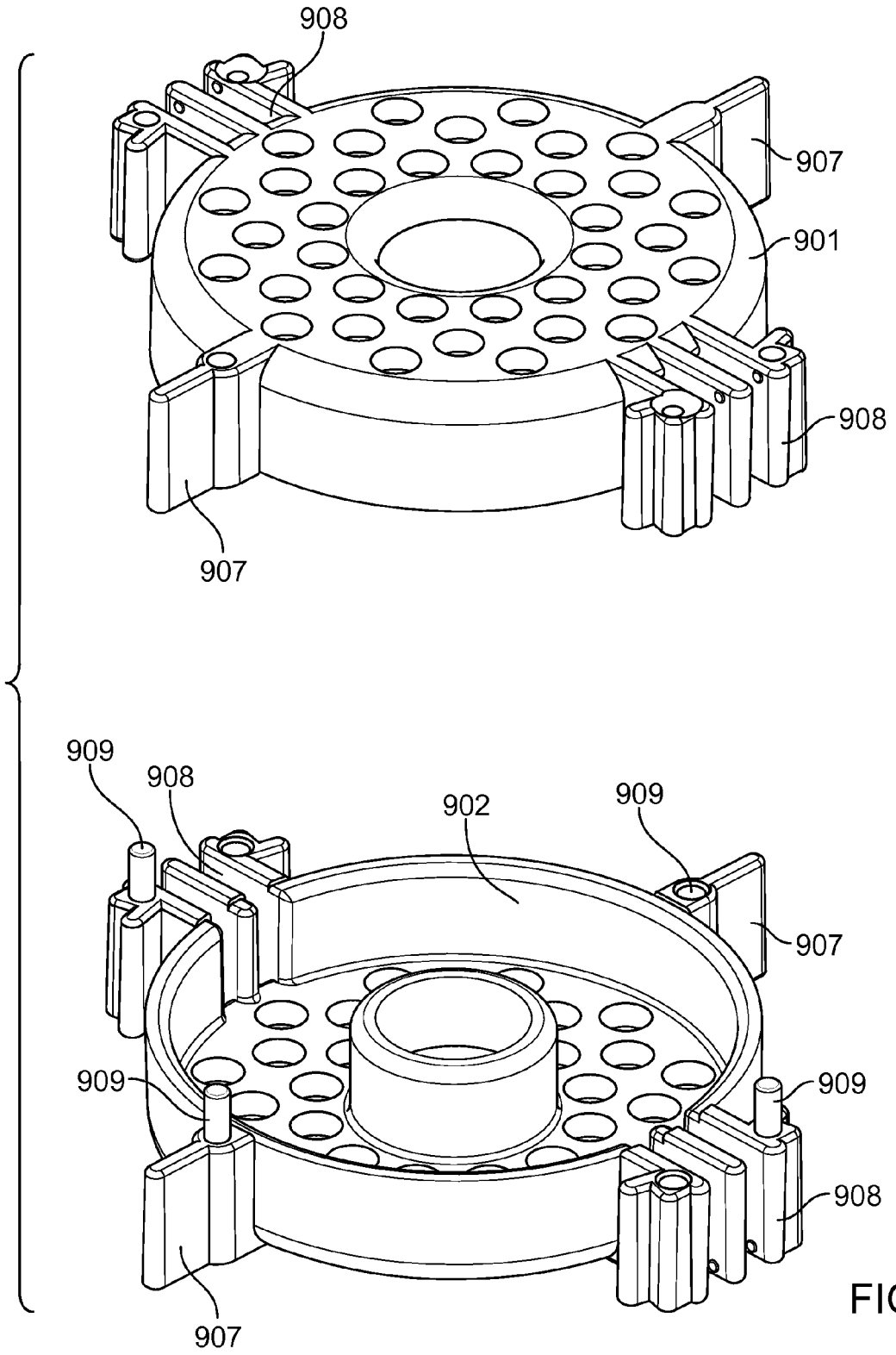
FIG. 9 shows a perspective view of two shells which form a preformed insulation structure.

As can furthermore be seen in FIG. 9, the insulation structure consists of two identically formed parts (for example two identically formed shells). In other examples, the insulation structure contains two identically formed parts (for example two shells) an additional elements. In this way, the production costs of the preformed insulation structure can be further reduced since the number of injection moulds required is reduced (or the number of moulds for other moulding methods).

The statements made above with regard to injection-moulding methods likewise apply to other moulding production methods. The parts described in FIGS. 2 to 10 can also be produced by such alternative moulding production methods.

The housings described herein for the transformers can be produced by the same production method as the preformed insulation structures. By way of example, the housing and all parts of a unipartite or multipartite preformed insulation structure can be produced by means of an injection-moulding method. Additionally or alternatively, the housing and the parts of the preformed insulation structure can be produced from the same material as the housing. The production costs for a transformer containing these parts can thus be further reduced. Moreover, in one example, the housing and one or a plurality of parts of the preformed insulation structure can be produced integrally (for example as an injection-moulded part). In one example, the preformed insulation structure consists of two shells and one of the shells is produced integrally with the housing as an injection-moulded part. The second shell can be a separate injection-molded part or can be connected the housing as well.

In one example, the parts of the preformed insulation structure (for example the shells from FIGS. 2 to 10) comprise a thermoplastic (consist of a thermoplastic). However, the parts of the preformed insulation structure can also comprise a thermosetting plastic (consist of a thermosetting plastic). As already mentioned, the housings in which the preformed insulation structures are embedded can consist of the same materials as the preformed insulation structures. In all examples described herein, the preformed insulation structures can comprise a material (consist of a material) which has a dielectric constant of 1 to 10 at 0 to 10 MHz.

In connection with FIGS. 2 to 8, devices having a first and a second winding were discussed, wherein the first and second windings substantially completely surround a ring-shaped transformer core (extend around the transformer core by more than 300° deg). However, the preformed insulation structures and housings described herein are not restricted to this number and arrangement of the windings and this transformer core.

In this regard, the transformer can have a rectangular or oval cross-section in other examples. Moreover, the transformer core can also extend in other geometries (for example rectangular or oval) rather than in a ring-shaped fashion (in or parallel to a plane including the magnetic field lines of the transformer core in operation). Moreover, the closed form of the transformer core as shown in FIGS. 2 to 8 is not obligatory. In other examples, a two part or multipartite transformer core structure can be employed with a correspondingly formed insulation structure. The geometry of the receptacle formed by the preformed insulation structure can also vary according to the geometry of the transformer core. With regard to FIGS. 2 to 10, the preformed insulation structure defines a closed, cylindrical area with a passage allowing the second winding to be wound. However, the preformed insulation structure can also define other closed areas. In other examples, the preformed insulation structure defines a ring-shaped torus. As already discussed further above, the interior of the preformed insulation structure can also be open towards one or a plurality of sides.

Figure 11A:
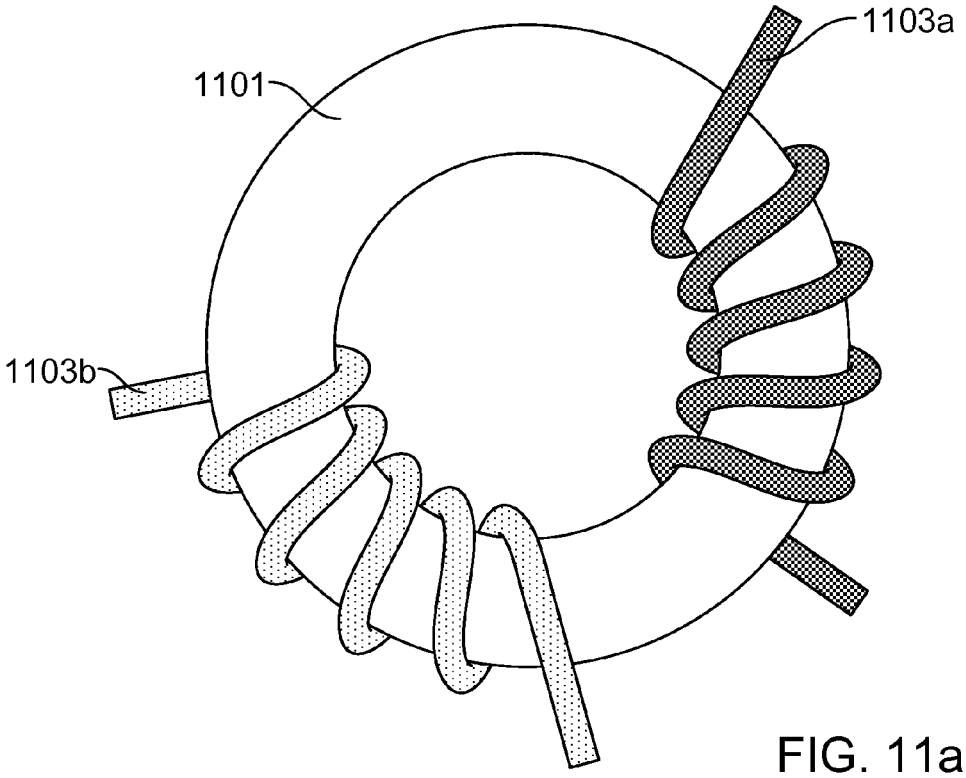
FIG. 11*a* shows a plan view of an example of a transformer core onto which two windings are wound.
Figure 11B:
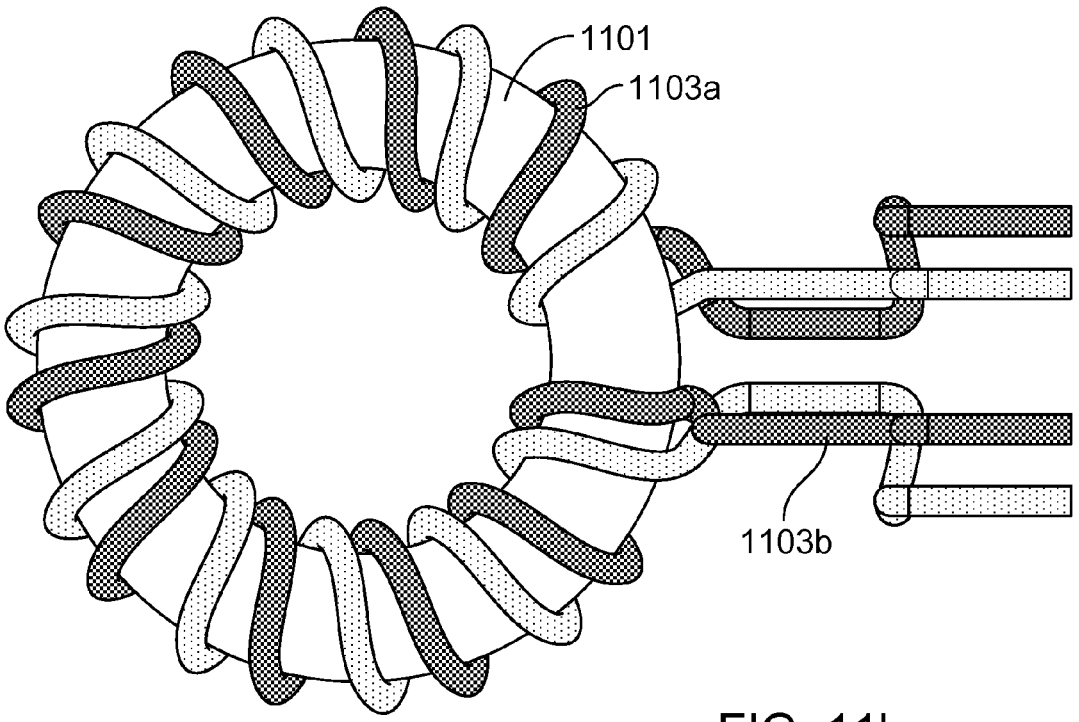
FIG. 11*b* shows a plan view of a further example of a transformer core onto which two windings are wound.

In other examples, the transformer contains a third or a third and further windings. FIGS. 11*a* and 11*b* show possibilities as to how a further winding can be arranged in the devices presented with reference to FIGS. 2 to 10. In one example, as shown in FIG. 11*a*, a plurality of windings 1103*a*, 1103*b* can be wound along the circumference of a transformer core 1101. In this case, the windings shown in FIGS. 11*a* and 11*b* can be wound both directly onto the transformer core and onto the preformed insulation structures from FIGS. 2 to 10.

Figure 12A:
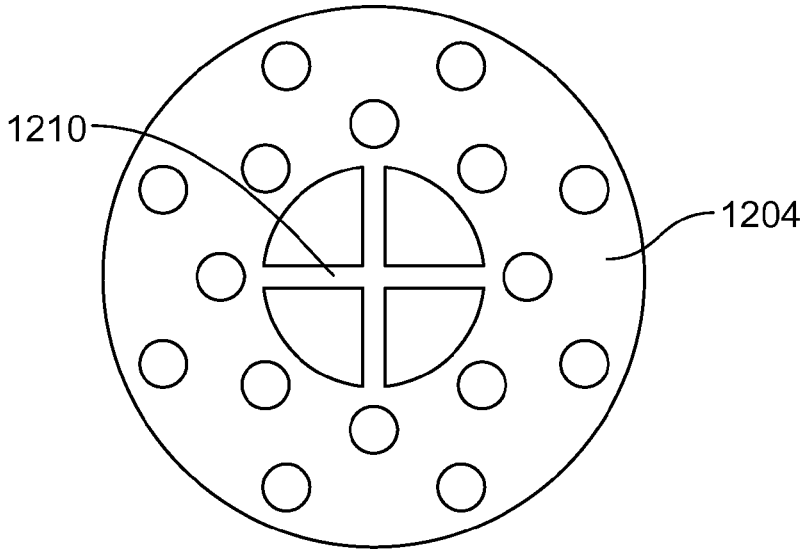
FIG. 12*a* illustrates a schematic plan view of a first shell of a further exemplary preformed insulation structure.
Figure 12B:
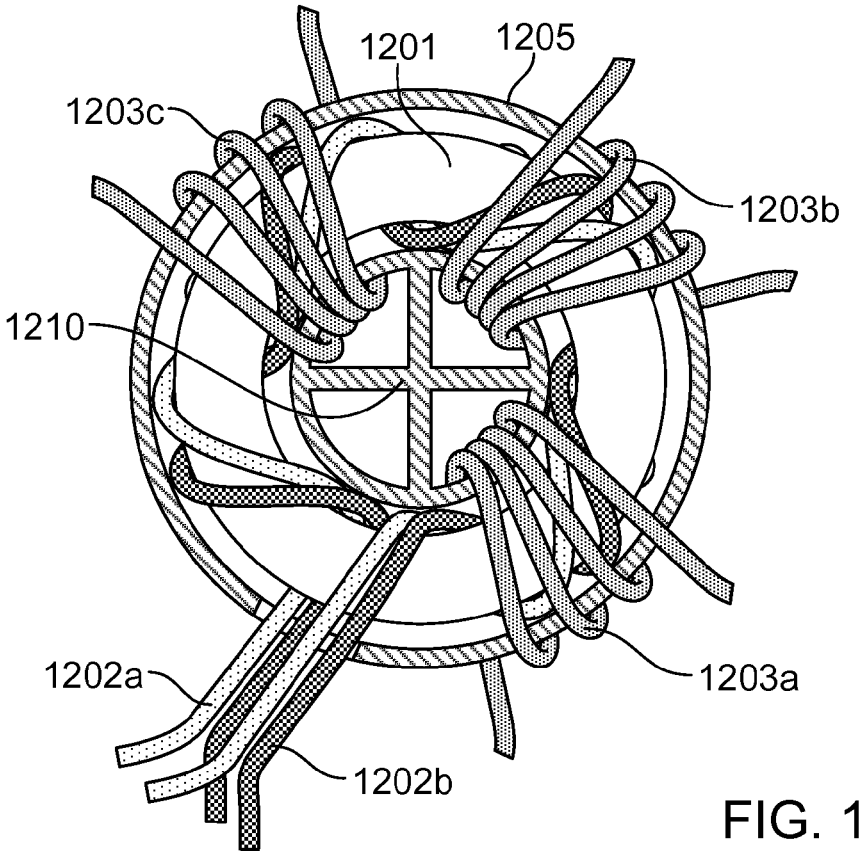
FIG. 12*b* illustrates a partial sectional view/plan view of two shells shown in FIG. 12*a* with a plurality of windings and a transformer core.

In the example in FIG. 11*a*, two windings are wound in each case only on a segment of the transformer core 1101 (for example in such a way that each winding extends along the transformer core for less than 175° deg). FIGS. 12*a* and 12*b* shows a further example of such an arrangement comprising three windings. In such an arrangement, the breakdown strength between a first winding, which is wound directly on the transformer core, and the further (for example two further) windings, which are wound around a preformed insulation structure, can furthermore be (concomitantly) determined by the preformed insulation structure. By contrast, the windings wound around the predetermined insulation structure can be insulated from one another by their distance along the transformer core.

FIG. 11*b* shows a further arrangement of two windings 1103*a*, 1103*b*. In this example, the two windings are arranged in a manner intertwined in one another around the entire transformer core 1101 (they extend around the transformer core by more than 300° deg). This arrangement of windings can reduce a leakage inductance. In the same way, a third winding or else further windings can be arranged in a manner intertwined in one another around the entire transformer core 1101.

FIGS. 12*a* and 12*b* show a further example of a preformed insulation structure and the arrangement thereof with a plurality of windings in a transformer. As also in FIGS. 2 to 10, FIGS. 12*a* and 12*b* reveal a preformed insulation structure consisting of two shells. FIG. 12*a* illustrates a schematic plan view of a first shell 1204 of the preformed insulation structure, which has a plurality of holes. For the sake of simplicity, optional additional structures (wire holders, connecting structures and/or positioning structures) are omitted in FIGS. 12*a* and 12*b*. However, each of the structures of this type discussed further above can be combined with the shells. In addition, the upper and lower shells 1204, 1205 have a winding aid 1210, with the aid of which a plurality of windings can be positioned along the circumference of the shells 1204, 1205. In FIG. 12*a*, said winding aid 1210 is embodied as two intersecting struts. Four segments are thus defined along the circumference of the first and second shells 1204, 1205.

FIG. 12*b* reveals, on the basis of a partial sectional view (only the upper shell is cut away; the windings and the transformer core are illustrated in a plan view), how different windings are arranged around two of the shells shown in FIG. 12*a*. In this example, two windings 1202*a*, 1202*b* are wound directly around the transformer core 1201 in a manner similar to that shown in FIG. 11*b*. The transformer core with the two windings 1202*a*, 1202*b* is enclosed by the first and second shells 1204, 1205 (the first shell cannot be seen in FIG. 12*b*). Three further windings 1203*a*-1203*c* are wound around the preformed insulation structure formed by the first and second shells 1204, 1205. Said windings are once again arranged in a manner similar to that in FIG. 11*a*. Each winding 1203*a*-1203*c* extends in a segment of the preformed insulation structure, which segment makes up less than 90° deg of the circumference of the preformed insulation structure. The winding aid 1210 limits each of the windings 1203*a*-1203*c* to a predetermined segment. Although FIG. 12*b* shows three windings 1203*a*-1203*c*, the winding aid can also be used for two or more than three windings. In the transformer in FIG. 12*b*, the two windings 1202*a*, 1202*b* wound directly onto the transformer core 1201 can be primary windings of the transformer, and the three windings 1203*a*-1203*c* can be secondary windings of the transformer. The segmented winding of the three windings 1023*a* to 1203*c* can result in a high mutual breakthrough resistance of the three windings 1023*a* to 1203*c*, in addition to a high breakthrough resistance of each of these windings and the windings 1202*a*, 1202*b* wound directly onto the transformer core. In the same way, in the examples shown in connection with FIGS. 2 to 11, the one or more windings wound directly onto the transformer core can be primary windings of the transformer and the one or more windings wound onto the preformed insulation structure can be secondary windings of the transformer. In other examples, the one or more windings wound directly onto the transformer core can be secondary windings of the transformer and the one or more windings wound onto the preformed insulation structure can be primary windings of the transformer. In addition, the three windings 1023*a* to 1203*c* can provide different voltage levels. This is not only the case for the example of FIGS. 12*a* and 12*b* but in general for all transformers described herein with two or more windings.

A plurality of preformed insulation structures in which two shells enclose a transformer core have been described in connection with FIGS. 2 to 12. In these examples, the first shell forms a top side of the preformed insulation structure and the second shell forms an underside. The "top side" and the "underside" are separated herein by a plane in which or parallel to which the magnetic flux runs through the transformer core during operation of the transformer core. In the example of a ring-shaped transformer core, this plane intersects the transformer core in such a way that two parts having ring-shaped intersection areas arise (see, for example, FIGS. 11*a* and 11 *b*, where the plane lies in the plane of the drawing).

In another example, two parts of a preformed insulation structure enclose a right and left part of the transformer core. The "right side" and the "left side" are separated herein by a second plane, perpendicular to which the magnetic flux runs through the transformer core during operation of the transformer core (this plane is therefore perpendicular to the plane defined in the last paragraph). In the example of a ring-shaped transformer core, said second plane intersects the transformer core in such a way that two parts having two circular intersection areas arise (or an intersection area having an oval cross section or figure-of-eight cross section—see, for example, FIGS. 11*a* and 11 *b*, where the plane intersects the plane of the drawing orthogonally).

Figure 13A:
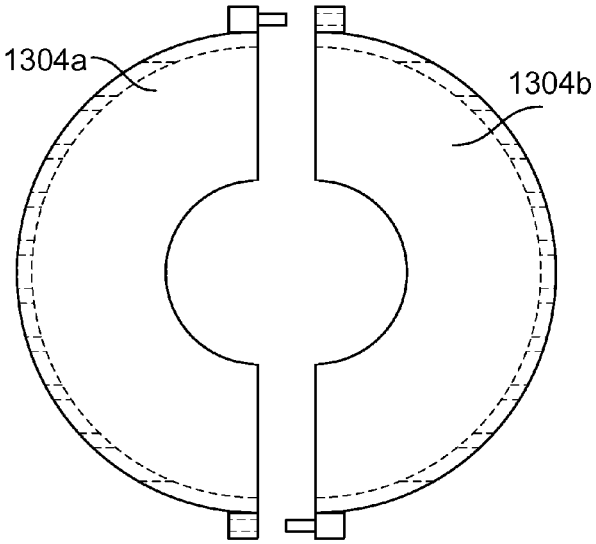
FIG. 13*a* illustrates a schematic plan view of the parts (two shells and a middle portion) of a three-part preformed insolation structure.
Figure 13A:
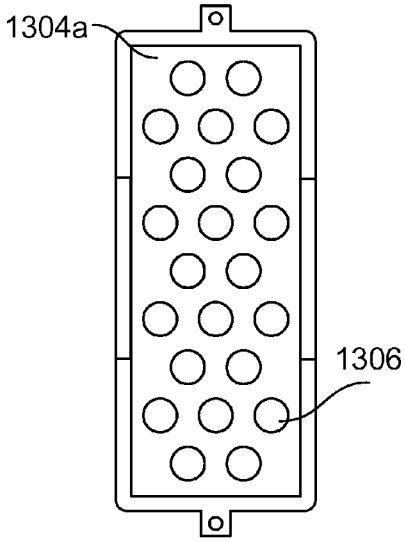
Figure 13A:
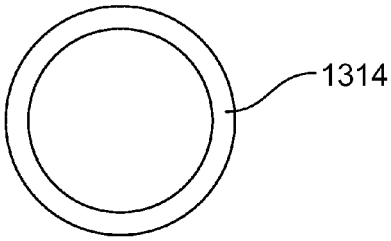
Figure 13B:
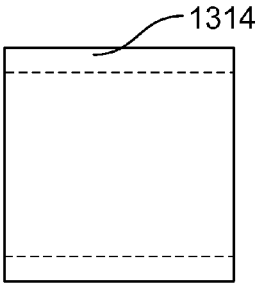
FIG. 13*b* illustrates a schematic side view of the parts of the preformed insulation structure of FIG. 13*a*.

FIGS. 13*a* and 13*b* show a further example of an insulation structure with multiple windings in a transformer. The preformed insulation structure of FIGS. 13*a* and 13*b* has three parts. A transformer core with multiple windings (e.g., a transformer core as shown in FIGS. 11*a* and 11 *b*) is enclosed by two half-shells 1304*a*, 1304*b*. A tubular central part 1314 is disposed in an aperture of the two half-shells 1304*a*, 1304*b*. Thus, the transformer core and the windings are completely enclosed by the preformed insulation structure. Further second windings can be wound around the half-shells through the tubular central part. These further second windings are spaced apart from the inner first winding by the tripartite insulation structure.

FIG. 13*a* shows a schematic plan view of the two shells 1304*a*, 1304*b* of identical size, which are configured to respectively enclose a right and a left side of a transformer core (not shown in FIG. 13*b*). Optionally, this preformed insulation structure in this example can comprise a tubular central part 1314. In this example, the assembly of the transformer comprises firstly introducing the transformer core with a first winding into one of the shells 1304*a*, 1304*b*. The second shell 1304*a*, 1304*b* is then connected to the first shell 1304*a*, 1304*b* in order to enclose the transformer core. The tubular central part 1314 can be led through before or after the connection of the shells 1304*a*, 1304*b*. Afterwards, a second winding can be wound onto the preformed insulation structure.

FIG. 13*b* shows a schematic side view of the two half-shells 1304. The half-shell 1304*a* has multiple holes 1306 to allow a potting material to enter the interior of a receptacle formed by the first and second half-shells 1304*a*, 1304*b*. The first and second half-shells 1304*a*, 1304*b* can have further features described herein, e.g., positioning structures, wire holders or feed throughs for wires.

In many of the previously described multipartite preformed insulation structures, the parts enclose the transformer core symmetrically. In other words, each part of the preformed insulation structure encloses an identical proportion of the transformer core. However, this arrangement is not obligatory. In other examples, one of two (or more) parts of a bipartite or multipartite preformed insulation structure can enclose a smaller proportion of the transformer core than the other part(s). In this regard, for example, in the arrangement depicted schematically in FIG. 3, the lower shell 205 can encompass the entire side wall. The upper shell 204 is then a cover which can be placed or plugged onto the lower shell 205.

Figure 14:
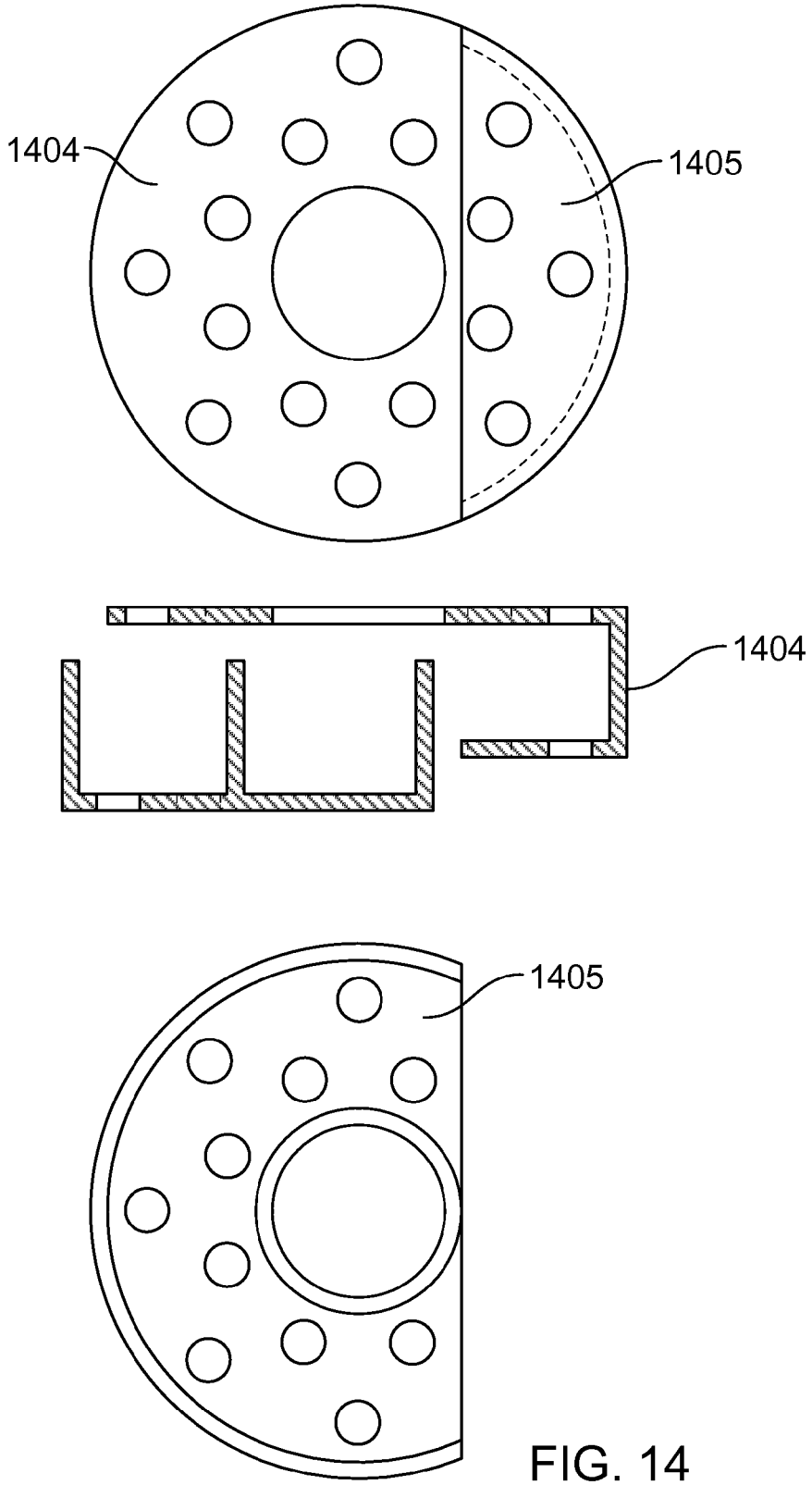
FIG. 14 illustrates a schematic plan view and a sectional view of the parts of a further exemplary preformed insulation structure.

FIG. 14 shows a further bipartite preformed insulation structure. A first part 1404 of this preformed insulation structure covers the top side (the definition of the term "top side" can be found further above), a first part of the outer side surface and a part of the underside (the definition of the term "underside" can be found further above) of a cylindrical receptacle. A second part 1405 of this preformed insulation structure covers the remaining part of the outer side surface and the remaining part of the underside. When assembled, therefore, both parts 1204, 1205 enclose the entire surface of the cylindrical receptacle (with the exception of a central cutout). In contrast to the shells shown for example in connection with FIG. 2, the parts shown in FIG. 14 are not symmetrical (that is to say that they cover differently sized parts of the surface of the cylindrical receptacle).

FIG. 2 shows a preformed insulation structure which defines an interior for receiving a transformer core and part of a first winding and an exterior, in which the second winding is wound. However, the transformer structures described herein are not restricted thereto. In this regard, in one example, a second preformed insulation structure can enclose a first preformed insulation structure. In this example, the first insulation structure encloses a transformer core with one or a plurality of first windings. One or a plurality of second windings are wound around the first insulation structure. The one or more second windings wound around the first insulation structure are in turn enclosed by the second preformed insulation structure. One or more third windings are wound around the latter. The two preformed insulation structures are therefore arranged like the layers of an onion. The bipartite or multipartite preformed insulation structures described above can be used in this arrangement comprising two preformed insulation structures.

In another example, the transformer core can be enclosed by a preformed insulation structure. One or more additional windings can be wound onto this preformed insulation structure. The transformer core and the one or more first windings can in turn be enclosed by a second preformed insulation structure. One or more second windings can be wound onto the second preformed insulation structure.

Some exemplary method steps for producing a transformer using a preformed insulation structure have already been described with reference to FIGS. 2 to 14. A further exemplary method comprises the following steps: providing a transformer core, winding a first wire around a transformer core in order to form a first winding, arranging a preformed insulation structure, such that the preformed insulation structure encloses at least part of the first winding and of the transformer core, and winding a second wire around the preformed insulation structure in order to form a second winding. The arrangement comprising windings, transformer core and preformed insulation structure can then be introduced into a housing. The housing can be potted with a potting compound. By way of example, the potting of the housing can be carried out by means of a die-casting method. Moreover, the potting of the housing can also be carried out under negative pressure conditions (i.e., at a pressure of 500 mbar or less). It is thereby possible to suppress the formation of air or gas bubbles in the potting compound.

If the preformed insulation structure comprises wire holders, at the beginning and after the end of the step of winding the first and/or second winding, the first and/or second wire can be fixed at a location in one of the wire holders. The winding process (whether manually or by machine) can thus be simplified since return movements of the wires can be reduced.

The above description of the illustrated examples of the present invention is not intended to be exhaustive or restricted to the examples. While specific embodiments and examples of the invention are described herein for illustrative purposes, various modifications are possible without departing from the present invention. The specific examples of voltage, current, frequency, power, values of ranges, times, etc. are merely illustrative, and so the present invention can also be implemented with other values for these variables.

These modifications can be carried out on examples of the invention in light of the detailed description above. The terms used in the following claims should not be interpreted so as to restrict the invention to the specific embodiments which are disclosed in the description and the claims. The present description and the figures should be regarded as illustrative and not as restrictive.

What is claimed is:

1. A transformer, comprising:

a transformer core;

a first wire, which forms a first winding;

a second wire, which forms a second winding, wherein the first and second windings are wound around the transformer core;

a preformed insulation structure arranged between the first and second winding and designed to space apart the second winding from the first winding and the transformer core;

wherein the preformed insulation structure further comprises:

a first shell which at least partially encloses the transformer core with the first winding;

a second shell which at least partially encloses the transformer core with the first winding and wherein the first and second shells are identical, wherein one or more holes are defined in the first shell and the second shell, and wherein the one or more holes cover more than 10% of a surface of the preformed insulation structure, and wherein the preformed insulation structure defines a passage through which the second wire can be wound around the transformer core.

2. The transformer according to claim 1, wherein the second winding is wound around the preformed insulation structure.

3. The transformer according to claim 1, wherein the preformed insulation structure remains substantially dimensionally stable when the second wire is wound around it.

4. The transformer according to claim 1, wherein the first shell and the second shell are designed to completely enclose the transformer core with the first winding.

5. The transformer according to claim 1, wherein the holes are round, oval, triangular, rectangular or multi-sided or have an irregular shape.

6. The transformer according to claim 1, wherein more than ten holes are defined in the preformed insulation structure.

7. The transformer according to claim 1, wherein the one or more holes are arranged such that when the transformer core and the first winding are arranged within the preformed insulation structure, an entire space not occupied by the transformer core and the first winding within the preformed insulation structure has a fluid connection to an exterior via the one or more holes.

8. The transformer according to claim 1, wherein the transformer further comprises a housing designed to receive the transformer core, the first and second windings and the preformed insulation structure.

9. The transformer according to claim 8, further comprising an insulation substance within the housing, wherein the insulation substance encloses the transformer core, the first and second windings, and the preformed insulation structure.

10. The transformer according to claim 9, wherein the insulation substance is selected from a potting compound, an oil or a gas.

11. The transformer according to claim 8, wherein the one or more holes defined in the preformed insulation structure are arranged such that an interior of the housing can be filled with an insulation substance without a formation of cavities when the transformer core, the first and second windings and the first and second shells are arranged in the housing.

12. The transformer according claim 9, wherein the housing has one or more projections, wherein the one or more projections are space apart the preformed insulation structure from an outer wall of the housing.

13. The transformer according to claim 1, wherein the preformed insulation structure defines a closed area and wherein one or more sides of the closed area are open to the transformer core and the first winding.

14. The transformer according to claim 2, wherein the preformed insulation structure has the form of a torus.

15. The transformer according to claim 1, wherein at least one of the first and second windings extends along the transformer core at least 300 degrees.

16. The transformer according to claim 1, wherein the transformer core is a toroid.

17. The transformer according to claim 1, wherein the transformer core is ring-shaped.

18. The transformer according to claim 1, wherein at least one of the first and second windings extends along the transformer core at most 175 degrees.

19. The transformer according to claim 1, further comprising one or more further wires, which form one or more further windings, wherein the one or more further windings are wound around the transformer core.

20. The transformer according to claim 19, wherein the first winding extends along the transformer core over at least 300 degrees and the second winding and the one or more further windings each extend along the transformer core over a different segment of the transformer core and are spaced apart from each other.

21. The transformer according to claim 1, wherein the transformer core defines a first plane, in which or parallel to which a magnetic flux of the transformer core runs during operation of the transformer, and wherein the preformed insulation structure is arranged between the first and second windings, such that the second winding is spaced apart from the first winding and the transformer core in a second direction, which is perpendicular to the first plane.

22. The transformer according to claim 1, wherein the preformed insulation structure is produced by an injection-moulding method.

23. The transformer according to claim 1, wherein the preformed insulation structure comprises a thermoplastic.

24. The transformer according to claim 1, wherein the preformed insulation structure comprises a material having a dielectric constant of 1 to 10 at 0 to 10 MHz.

25. The transformer according to claim 1, wherein the preformed insulation structure comprises one or more wire holders, wherein at least one of the first and second wires can be secured.

26. The transformer according to claim 1, wherein the preformed insulation structure comprises one or more positioning structures, wherein the one or more positioning structures fix the position of the preformed insulation structure inside a housing in one or more directions.

27. The transformer according to claim 26, wherein the one or more positioning structures comprise projections arranged on a surface of the preformed insulation structure, wherein the projections are dimensioned such that the distance between the second winding and a side surface of the housing is constant.

28. The transformer according to claim 1, wherein the transformer core defines a first plane, in which or parallel to which a magnetic flux of the transformer core runs during operation of the transformer, wherein a top side and an underside of the transformer core extend parallel to the first plane, and wherein the first shell encloses the top side and the second shell encloses the underside of the transformer core.

29. The transformer according to claim 1, wherein the transformer core defines a first plane, in which or parallel to which a magnetic flux of the transformer core runs during operation of the transformer, wherein a second plane, which separates a first half and a second half of the transformer core, is perpendicular to the first plane, and wherein the first shell encloses the first half and the second shell encloses the second half of the transformer core.

30. The transformer according to claim 1, wherein the preformed insulation structure further comprises one or more winding aids for at least one of the first and second wires.

* * * * *